US012649999B2

(12) United States Patent
Hall

(10) Patent No.: US 12,649,999 B2
(45) Date of Patent: Jun. 9, 2026

(54) BUCKET

(71) Applicant: Austin Engineering Limited, Kewdale (AU)

(72) Inventor: Jamie Vincent Clarke Hall, Kalamunda (AU)

(73) Assignee: Austin Engineering Limited, Kewdale (AU)

( * ) Notice: Subject to any disclaimer, the term of this patent is extended or adjusted under 35 U.S.C. 154(b) by 625 days.

(21) Appl. No.: 18/008,603

(22) PCT Filed: Jun. 8, 2021

(86) PCT No.: PCT/AU2021/050574
§ 371 (c)(1),
(2) Date: Dec. 6, 2022

(87) PCT Pub. No.: WO2021/248183
PCT Pub. Date: Dec. 16, 2021

(65) Prior Publication Data

US 2023/0250607 A1 Aug. 10, 2023

(30) Foreign Application Priority Data

Jun. 8, 2020 (AU) ..... 2020203766

(51) Int. Cl.
*E02F 3/40* (2006.01)
*E02F 9/28* (2006.01)

(52) U.S. Cl.
CPC ..... *E02F 3/40* (2013.01); *E02F 9/2883* (2013.01)

(58) Field of Classification Search
CPC ... E02F 3/40; E02F 3/60; E02F 9/2883; E02F 3/8152; E02F 3/14; E02F 3/3417
See application file for complete search history.

(56) References Cited

U.S. PATENT DOCUMENTS 7,698,839 B1 * 4/2010 Phillips ..... E02F 3/40 37/906
8,839,534 B2 * 9/2014 Zeno ..... E02F 3/40 414/722

(Continued)

FOREIGN PATENT DOCUMENTS

JP 2002294739 A 10/2002
JP 2006322206 A 11/2006

(Continued)

OTHER PUBLICATIONS

International Search Report for Application No. PCT/AU2021/050574 mailed Aug. 31, 2021, pp. 1-6.

*Primary Examiner* — Christopher J Sebesta
*Assistant Examiner* — Blake E Scoville
(74) *Attorney, Agent, or Firm* — Lerner David LLP

(57) ABSTRACT

A bucket for use on a loader is disclosed including a main wall which transitions from a lower main wall portion into an upper main wall portion. It includes two side walls extending between the lower main wall portion and the upper main wall portion. The main wall and the side walls define an interior space and an open mouth at a front end of the bucket. The lower portion of the main wall, the upper portion of the main wall and the side walls may be engineered to provide a suitable structural strength and wear resistance by selection of an appropriate thickness and hardness of steel for each of the walls and portions of the walls. A loader including the bucket is also disclosed.

22 Claims, 9 Drawing Sheets

(56) References Cited

U.S. PATENT DOCUMENTS

| | | | | |
|---|---|---|---|---|
| 9,428,881 | B1 * | 8/2016 | Chabura | E02F 3/40 |
| 9,670,643 | B2 * | 6/2017 | Caux | E02F 3/40 |
| 2012/0301258 | A1 * | 11/2012 | Nagata | E02F 3/40<br>414/723 |
| 2013/0025171 | A1 * | 1/2013 | Torgrimsen | E02F 9/2883<br>37/444 |
| 2014/0237869 | A1 * | 8/2014 | Caux | E02F 3/40<br>37/444 |
| 2018/0058034 | A1 * | 3/2018 | Worth | E02F 3/40 |
| 2018/0087236 | A1 * | 3/2018 | Marek | E02F 3/40 |

FOREIGN PATENT DOCUMENTS

| | | | | |
|---|---|---|---|---|
| WO | WO-2011102731 | A1 * | 8/2011 | E02F 3/40 |
| WO | WO-2018213883 | A1 * | 11/2018 | E02F 9/2883 |

* cited by examiner

BUCKET

CROSS-REFERENCE TO RELATED APPLICATIONS

The present application is a national phase entry under 35 U.S.C. § 371 of International Application No. PCT/AU2021/050574, filed on Jun. 8, 2021, which claims priority to Australian Application No. 2020203766, filed on Jun. 8, 2020, the disclosures of which are hereby incorporated herein by reference in their entireties.

FIELD

This invention relates to a bucket for a loader. It also extends to a loader including the bucket.

The invention relates particularly, but not exclusively, to a bucket used on LHD loaders in underground mining operations and it will be convenient to hereinafter describe the invention with reference to this example form. The bucket can also be used on front end loaders used in above ground applications. Further, it will be appreciated that the bucket many be used for other applications.

BACKGROUND

Load Haul Dump (LHD) loaders have been developed for handling broken rock material in hard rock mining applications. The loaders are rugged and highly manoeuvrable and are widely used in underground mining operations. Applicant understands that more than 75% of world's underground metal mines use LHD loaders for handling the muck and broken rock generated by their mining operations.

Above ground loaders, e.g. wheeled loaders or front end loaders, which operate above the ground surface may be used for similar tasks in above ground applications.

An integral part of an LHD loader is the bucket which contacts the material to handled and picks up the material and then dumps it in a different location. Some prior art LHD loader bucket designs consist of a bucket body fabricated from high tensile steel having a set of replaceable wear liners welded onto an internal surface of the underlying body. In operational use on a loader, these wear liners are subject to high levels of abrasion and wear and are required to be removed and replaced periodically. Typically, one such bucket would be fitted with several sets of wear liners over the course of its working lifetime.

A prior art bucket for an excavator of the type known in the prior art is illustrated in FIG. 2. The bucket has a main wall transitioning from a lower portion into an upper portion at a rear of the bucket, and side walls extending between the upper and lower portions and closing off sides of the bucket.

The bucket has a set of removeable wear liners mounted on the main wall and the side walls of the bucket. Naturally, the wear liners are mounted on high wear areas of the bucket such as the lower portion of the main wall and also lower regions of the side walls.

The wear liners shield the underlying steel wall of the bucket from wear. Typically, the walls of the bucket are formed from a high tensile steel having a BHN hardness of about 200-300 BHN. This steel can be used in the walls of the bucket because the walls are covered by replaceable wear liners which shield the underlying steel wall from wear. Over time with operational use, the wear liners wear out and they need to be replaced with a fresh set of wear liners. This sequence of wearing down the wear liners and then replacing them occurs several times during the lifetime of the bucket.

The wear liners are welded on the underlying walls of the bucket and when they are replaced the liners need to be cut off the underlying bucket. This is done with cutting equipment such as oxyacetylene torches. However, cutting the wear liners off the steel walls is a hazardous operation as there is a risk of release of stored energy when the liner is cut free. The release of stored energy can cause the liner to move violently off the bucket when it is finally separated from the wall and is dangerous. There have been accidents where workers have been injured by the release of stored energy when a liner is cut off a bucket.

There are other disadvantages associated with the use of replaceable wear liners on buckets. For example, the wear liners are bulky, and the liners mounted on the main wall and side walls inside the bucket interfere with the flow of broken material within the bucket. They can also result in longer times being taken to unload the bucket which reduces productivity. Additionally, the liners mounted on the bucket can also reduce the efficiency with which the bucket can be driven into a muck pile to load the bucket. This contributes to "drag" and reduces the efficiency of loading the bucket.

The liners also contribute to dead space within the bucket which reduces the volume of material which can be loaded into the bucket each time it is filled with material. Naturally, this also reduces the productivity of the bucket.

Another disadvantage of using replaceable wear liners on a bucket is the cost of replacing the liners each time they wear out. The capital cost of each set of wear liners is significant. Further, the cost of labour to firstly remove the worn liners and then replace the worn liners with new liners is significant. Additionally, the downtime of the loader on which the bucket is replaced can be significant.

Consequently, there is a desire to move away from the use of removeable liners on buckets. Applicant is aware that some Mine Operators consider that prior art buckets with replaceable liners pose an unacceptable safety risk due to the release of stored energy and they are seeking alternative solutions.

The reference to prior art in the background above is not and should not be taken as an acknowledgment or any form of suggestion that the referenced prior art forms part of the common general knowledge in Australia or in any other country.

SUMMARY OF THE DISCLOSURE

Applicant recognizes there is a strong imperative to develop an alternative to the prior art buckets with replaceable liners. These include both a safety imperative and an operational imperative.

According to one aspect of the disclosure there is provided a bucket that is not fitted with replaceable wear liners, for use on a loader, the bucket including:

- a main wall which transitions from a lower main wall portion into an upper main wall portion;
- one side wall extending between the lower main wall portion and the upper main wall portion on one side, and
- another side wall extending between the lower and the upper main wall portions on the other side, the main wall and the side walls together defining an interior space and an open mouth at a front end of the bucket through which material enters and is discharged from the bucket, wherein the lower portion of the main wall, the upper portion of the main wall and the side walls are engineered to provide a suitable structural strength and wear resistance by selection of an appropriate thickness and hardness of steel for each of the walls and portions of walls.

The lower portion of the main wall, the upper portion of the main wall and the side walls are permanent and are not replaced over the lifetime of the bucket, and instead are designed to withstand the wear conditions to which the bucket will be exposed in use over its life time.

The lower main wall portion may extend rearward from the mouth at the front end of the bucket and transition into the upper main wall portion at a rear end of the bucket at which point the main wall portion turns back and extends forward towards the mouth of the bucket.

The bucket may include a 'base wall section' at a point on the bucket where the thickness of steel is at its minimum thereby providing a reference against which the thickness of steel at other points can be measured, and the base wall section has a base wall thickness.

The 'base wall section' may be located on the upper portion intermediate the front and rear ends of the bucket.

The 'base wall section' encounters the lowest levels of wear in operational use of the bucket and this is why the base wall thickness is less than the side walls and the lower main wall portion.

The base wall section may also have a BHN (Brinell hardness) value that is less than that of the lower portion of the main wall and the side walls.

The lower main wall portion may have lower main wall side zones on each side thereof towards the side walls, and the lower main side wall zones may have a thickness at least 20% thicker than the base wall thickness. Preferably, the thickness of the lower main side wall zones is at least 50% thicker than the base wall thickness, e.g. at least 80% thicker.

The lower main wall side zones may extend from adjacent to or proximate to the mouth to the rear end, e.g. corresponding to a rear end of the lower main wall portion. Optionally, the lower main wall side zones may extend beyond the rear end of the lower main wall portion and into the upper main wall portion.

The average width of each lower main wall side zone may be at least 10% of the width of the lower main wall portion of the bucket, preferably the average width is at least 15% of the width of the lower main wall portion.

The lower main wall portion may optionally further include an intermediate lower main wall zone between the lower main wall side zones, and the intermediate lower main wall zone may have a thickness that is at least 20% thicker than the base wall thickness. Preferably, the intermediate lower main wall zone is at least 50% thicker than the base wall thickness, e.g. at least 80% thicker.

The lower main wall side zones and optionally also the intermediate lower main wall zone may have a BHN that is at least 10% greater than the BHN of the base wall section, preferably at least 25% greater than the BHN of the base wall section. For example, the lower main wall side zones and optionally also the intermediate lower main wall zone may have a BHN of 400-500, e.g. about 450 BHN.

Further, the thickness of the intermediate lower main wall zone may be greater than that of the lower main wall side zones, e.g. at least 5% thicker than the intermediate lower main wall zone. In some designs and applications, the thickness of the lower main wall side zones may be greater than that of the intermediate lower main wall zone, e.g. at least 5% thicker than the intermediate lower main wall zone.

Further, the intermediate lower main wall zone may optionally broaden out towards the front of the bucket and extend substantially across the full width of the bucket. This helps to counter high wear on the lower main wall portion adjacent to the mouth.

Each side wall may have an upstanding frontal zone extending from the lower main wall portion to the upper main wall portion adjacent to the mouth, and the upstanding frontal zone may have a thickness that is at least 50% thicker than the base wall thickness, preferably at least 100% thicker than the base wall thickness, e.g. at least 200% thicker.

Each upstanding frontal zone may have a mean width in a direction rearward from the front end that is at least 10% of the depth of the bucket, the depth of the bucket being a linear distance from the front end to the rear end of the bucket.

The thickness of the upstanding frontal zone of the side wall may be at least 10% thicker than the thickness of the lower main wall side zones, preferably at least 20% thicker than the lower main wall side zones.

The upstanding frontal zones of the side wall may have a BHN that is at least 10% greater than the BHN of the base wall section, preferably at least 25% greater than the BHN of the base wall section. For example, the upstanding frontal zones may have a BHN of 400 to 500, e.g. about 450 BHN. It is conceivable that in some applications the upstanding frontal zones may have a hardness of 500 BHN.

Each upstanding frontal zone of a side wall may have a lower upstanding frontal section and an upper upstanding frontal section, and the thickness of the lower upstanding frontal section may be equal to or greater than the thickness of the upper upstanding frontal section.

Advantageously, the lower upstanding frontal section is thicker than the upper upstanding frontal section and also has a greater BHN hardness than the upper upstanding frontal section.

Further, the lower upstanding frontal section may extend up 20 to 40% of the height of the side wall adjacent to the mouth and the upper upstanding frontal section may extend up 60 to 80% of the height of the side wall.

Each side wall may include a lower arcuate edge zone extending from the mouth rearward along a lower edge of the side wall that is adjacent to the lower main wall portion, and the lower arcuate edge zone may have a thickness that is at least 50% greater than the base wall thickness, preferably at least 90% greater.

The lower arcuate edge zones of the side wall may have a BHN that is at least 10% greater than the BHN of the base wall section, preferably at least 25% greater than the BHN of the base wall section. For example, the upstanding frontal zones may have a hardness of 400 to 500 BHN, e.g. about 450 BHN.

Further, the thickness of the upstanding frontal zone of the wall may be greater than the thickness of the lower arcuate edge zone, preferably at least 10% thicker.

The arcuate edge zone may have a mean width that is greater than the mean width of the upstanding frontal zone. Optionally, the mean width of the arcuate edge zone may be at least 20% greater than the width of the upstanding frontal zone.

The bucket may include a bucket handling arrangement for controlling and manoeuvring a bucket on a loader. In one form where the bucket is to be used on an underground LHD loader, the bucket handling arrangement may be received to some extent within the interior space of the bucket.

In this form, the bucket may further include an internal handling arrangement plate within the interior space of a bucket on or adjacent to the bucket handling arrangement, and the internal handling arrangement plate may have a thickness that is at least 50% thicker than the base wall thickness, preferably at least 80% thicker.

The bucket may further include an external handling arrangement plate on or adjacent to the bucket handling arrangement outside the interior space of the bucket. The external handling arrangement plate may have a thickness that is at least 50% thicker than the base wall thickness, preferably at least 80% thicker.

In another form where the bucket is to be used on an above ground wheeled loader, the bucket handling arrangement may project out from the rear of the bucket to some extent.

In this form, the bucket may further include an external handling arrangement plate on the bucket handling arrangement outside of the interior space, the bucket handling arrangement plate having a thickness that is that is at least 50% thicker than the base wall thickness, preferably at least 80% thicker than the base wall thickness.

The internal and external handling arrangement plates may have a BHN that is at least 10% greater than the BHN of the base wall section, preferably at least 25% greater than the BHN of the base wall section. For example, the bucket handling arrangement plates may have a BHN of 400-500.

The bucket may include replaceable ground engaging formations (GET) mounted on the main and side walls of the bucket. The ground engaging formations are typically mounted on the bucket by means of mechanical fastening systems and/or welding and are adapted to be removed from a bucket and replaced quickly and easily.

GET formations are widely used on buckets for loaders and are consumable items that are periodically replaced. They are to be clearly distinguished from replaceable liners that are welded onto the walls of the bucket.

The (GET) ground engaging formations are mounted on the bucket at sites of extreme wear and used to reduce the wear of the main and side walls of the bucket. The ground engaging formations include teeth, shrouds, underside lip profile bars, grouser bars, blocks, and bars and are mounted in the following locations:

along the lower main wall portion at the front end;

on the side walls at the front end;

along the lower ends of the side walls in a direction rearward of the front end; and on an underside of the lower main wall portion near the front end.

The bucket may be designed for use on an LHD loader used in underground mining operations.

Instead, the bucket may be designed for use on an above ground loader, e.g. a wheeled loader, for use in above ground material handling.

According to yet another aspect of the disclosure there is provided a bucket for use on a loader, e.g. an LHD loader, the bucket including:

a main wall comprising a lower main wall portion and an upper main wall portion, one side wall extending between the lower main wall portion and the upper main wall portion on one side, another side wall extending between the lower and the upper main wall portions on the other side, and the main wall and the side walls together define an interior space and an open mouth at a front end of the bucket and a rear end remote from the front end, and the main wall transitions from the lower main wall portion to the upper main wall portion at the rear end, wherein the lower main wall portion has a thickness that is at least 20% thicker than the upper main wall portion, preferably at least 50% thicker than the upper main wall portion, and the one and other side walls have a thickness that is at least 20% thicker than the upper main wall portion, preferably at least 50% thicker than the upper main wall portion.

The main wall and side walls form a wear surface of the bucket.

The thickness of the lower main wall portion and upper main wall portion may be the mean or average thickness of the respective wall portions across their extent.

Similarly, the thickness of the one and other side walls may be the mean or average thickness of the side walls across their extent.

The bucket may include any one or more of the features of the bucket defined in any preceding aspect of the disclosure.

According to yet another aspect of the disclosure there is provided a bucket for use on a loader, e.g. an LHD loader, the bucket including:

a main wall comprising a lower main wall portion and an upper main wall portion, one side wall extending between the lower main wall portion and the upper main wall portion on one side, another side wall extending between the lower and the upper main wall portions on the other side, and wherein the main wall and the side walls together define an interior space and an open mouth at a front end of the bucket and a rear end remote from the front end and the main wall transitions from the lower main wall portion to the upper main wall portion at the rear end, wherein each side wall includes an upstanding frontal zone extending from the lower main wall portion to the upper main wall portion adjacent to the mouth, and the upstanding frontal zone has a thickness that is at least 20% greater than the upper main wall portion, preferably at least 50% thicker than the upper main wall portion, and more preferably at least 80% thicker, and each side wall includes a lower arcuate edge zone extending from the mouth rearward along a lower edge of the side wall that is adjacent to the lower main wall portion, and the lower arcuate edge zone has a thickness that is at least 20% greater than the upper main wall portion, preferably at least 50% thicker than the upper main wall portion.

The main wall and side walls form a wear surface of the bucket.

The thickness of the lower main wall portion and upper main wall portion may be the mean or average thickness of the respective wall portions across their extent.

Similarly, the thickness of the upstanding frontal zones, and the lower arcuate edge zones, of the one and other side walls may be the mean or average thickness of the upstanding frontal and lower arcuate edge zones respectively, across their extent.

The lower main wall portion may have a thickness that is at least 20% thicker than the upper main wall portion, and preferably at least 50% thicker than the upper main wall portion.

Further, the lower main wall portion may have lower main wall side zones on each side thereof towards the side walls, and the lower main side wall zones may have a thickness that is at least 20% thicker than the upper main wall portion, preferably at least 50% thicker than the upper main wall portion, and more preferably at least 80% thicker.

The thickness of the lower main wall side zones may be the mean or average thickness across of these zones across their extents.

The lower main wall portion may have an intermediate lower main wall zone positioned between the lower main wall side zones, and the intermediate lower main wall zone may have a thickness at least 20% thicker than the upper main wall portion, preferably at least 50% thicker.

The thickness of the intermediate lower main wall zone may be the mean or average thickness of this zone across its extent.

The bucket may include any one or more of the features of the bucket defined in any preceding aspect of the disclosure.

According to yet another aspect of the disclosure there is provided a bucket for use on a loader, e.g. an LHD loader, the bucket including:

a main wall comprising a lower main wall portion and an upper main wall portion, one side wall extending between the lower main wall portion and the upper main wall portion on one side, another side wall extending between the lower and the upper main wall portions on the other side, and the main wall and the side walls together define an interior space and an open mouth at a front end of the bucket and a rear end remote from the front end, and the main wall transitions from the lower main wall portion to the upper main wall portion at the rear end, wherein the lower main wall portion has a thickness that is at least 20% thicker than the upper main wall portion, preferably at least 50% thicker than the upper main wall portion.

The thickness of the lower main wall portion and upper main wall portion may be the mean or average thickness of the respective wall portions across their extent. Similarly, the thickness of the one and other side walls may be the mean or average thickness of the side walls across their extent.

The bucket may include any one or more of the features of the bucket defined in any preceding aspect of the disclosure.

According to yet another aspect of the disclosure there is provided a bucket for use on a loader, e.g. an LHD loader, the bucket including:

a main wall comprising a lower main wall portion and an upper main wall portion, one side wall extending between the lower main wall portion and the upper main wall portion on one side, another side wall extending between the lower and the upper main wall portions on the other side, and the main wall and the side walls together define an interior space and an open mouth at a front end of the bucket and a rear end remote from the front end, and the main wall transitions from the lower main wall portion to the upper main wall portion at the rear end, wherein the one and other side walls have a thickness that is at least 20% thicker than the upper main wall portion, preferably at least 50% thicker than the upper main wall portion.

The thickness of the lower main wall portion and upper main wall portion may be the mean or average thickness of the respective wall portions across their extent. Similarly, the thickness of the one and other side walls may be the mean or average thickness of the side walls across their extent.

The bucket may include any one or more of the features of the bucket defined in any preceding aspect of the disclosure.

The disclosure extends to a loader including a prime mover having ground engaging formations for moving across the ground, and a bucket controlling arrangement mounted on the prime mover including arms projecting forward from the prime mover, and a bucket in any other aspects of the disclosure mounted on the arms.

The loader may be mounted on wheels that is used in underground mining operations.

The vehicle may be a loader and the ground engaging formations may be wheels.

The loader may be an LHD loader used in underground mining operations. Instead, the loader may be a wheeled loader used in above ground operations.

The bucket may have any one or more of the features defined in any one of the preceding aspects of the disclosure.

The bucket has permanent walls are that engineered to provide the appropriate structural strength and wear resistance by a selection of thickness and hardness of steel. In particular, the bucket is not fitted with replaceable wear liners.

BRIEF DESCRIPTION OF DRAWINGS

A bucket for a loader and a loader including the bucket in accordance with this disclosure may manifest itself in a variety of forms. It will be convenient to hereinafter describe several embodiments of the disclosure in detail with reference to the accompanying drawings. The purpose of providing this detailed description is to instruct persons having an interest in the subject matter of the invention how to carry the disclosure into practical effect. However, it is to be clearly understood that the specific nature of this detailed description does not supersede the generality of the preceding broad description. In the drawings:

DETAILED DESCRIPTION

Figure 1A:
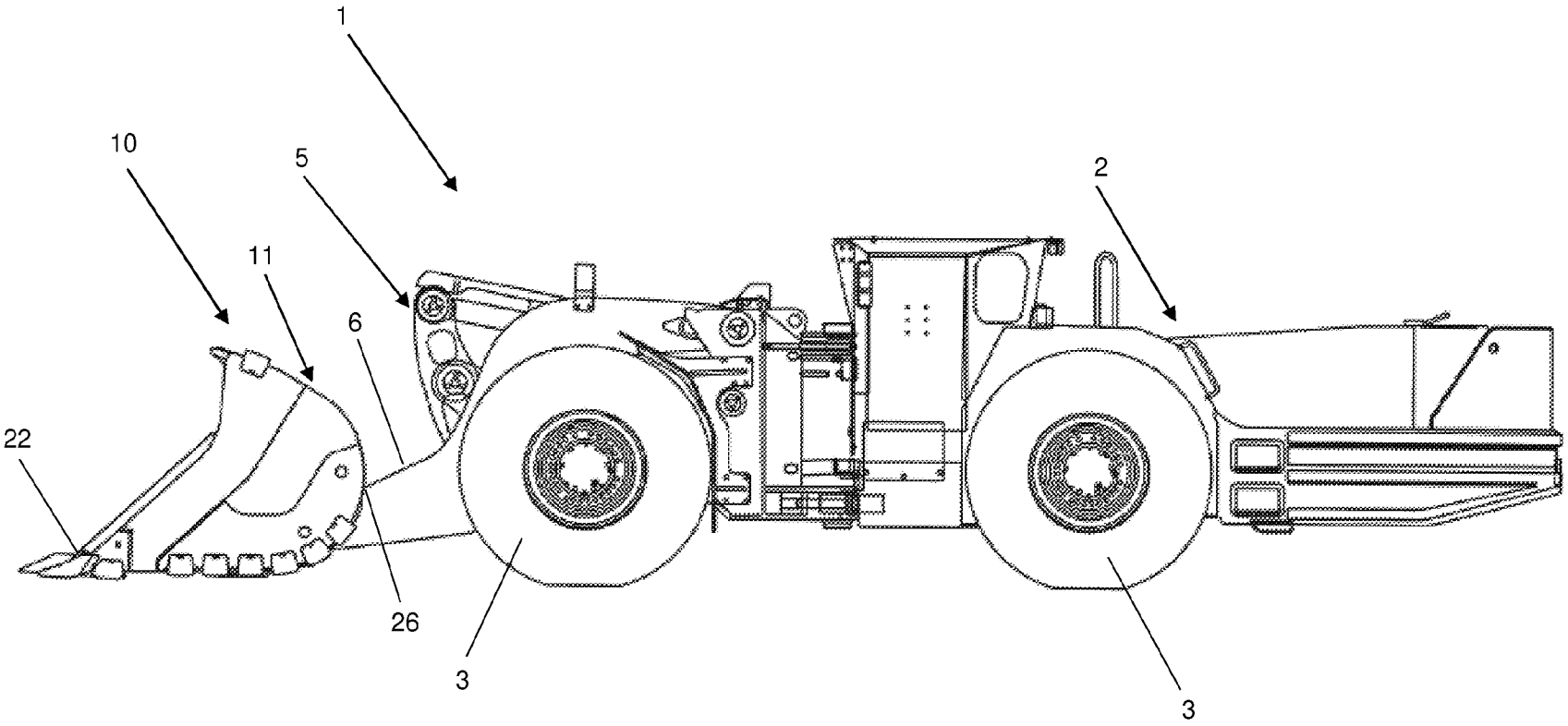
Figure 1B:
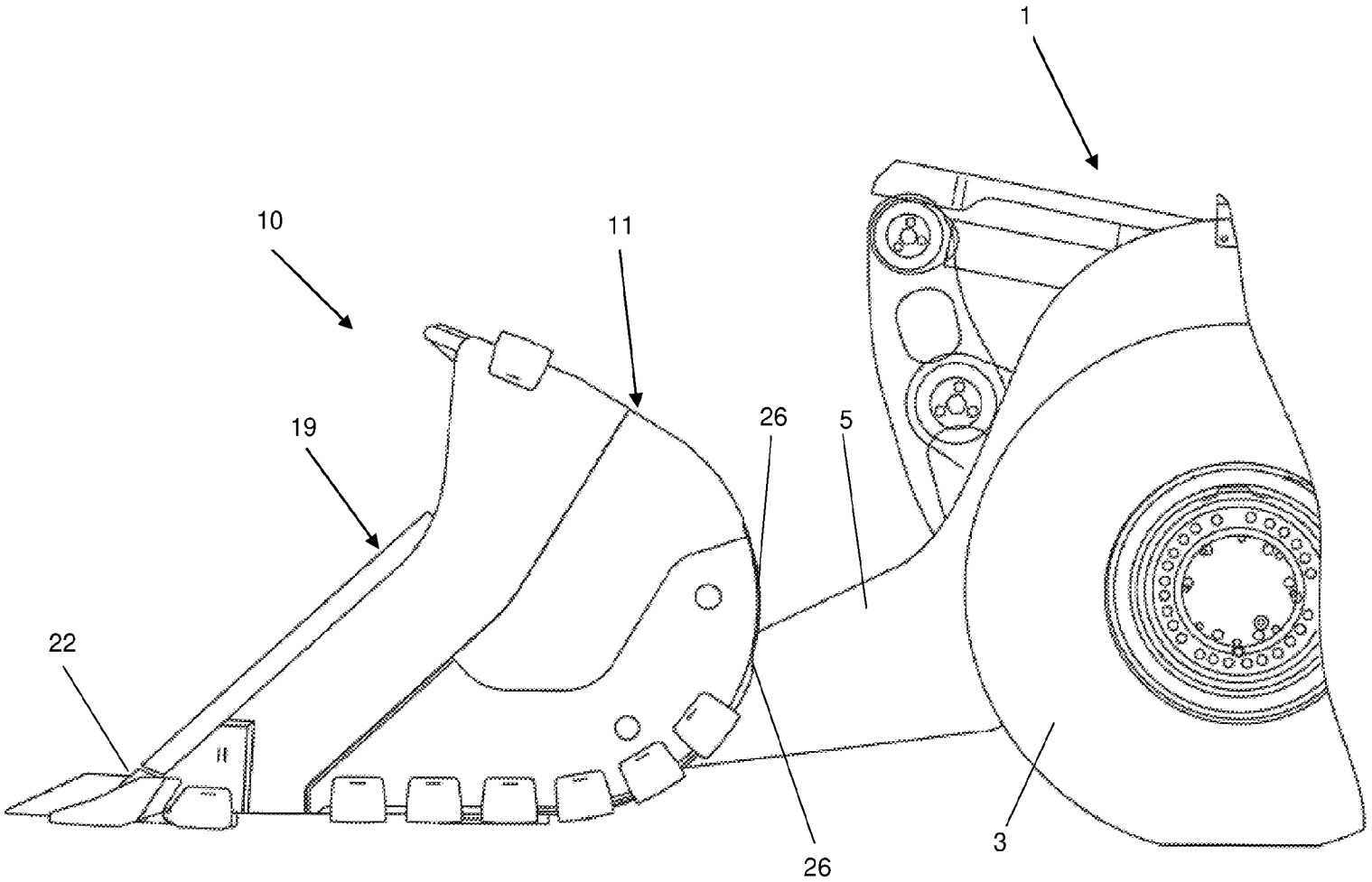

FIG. 1*a* shows a schematic drawing of a LHD loader having a bucket for loading and dumping broken rock material;

FIG. 1*b* shows a close up view of the bucket on the loader of FIG. 1*a;*

Figure 2:
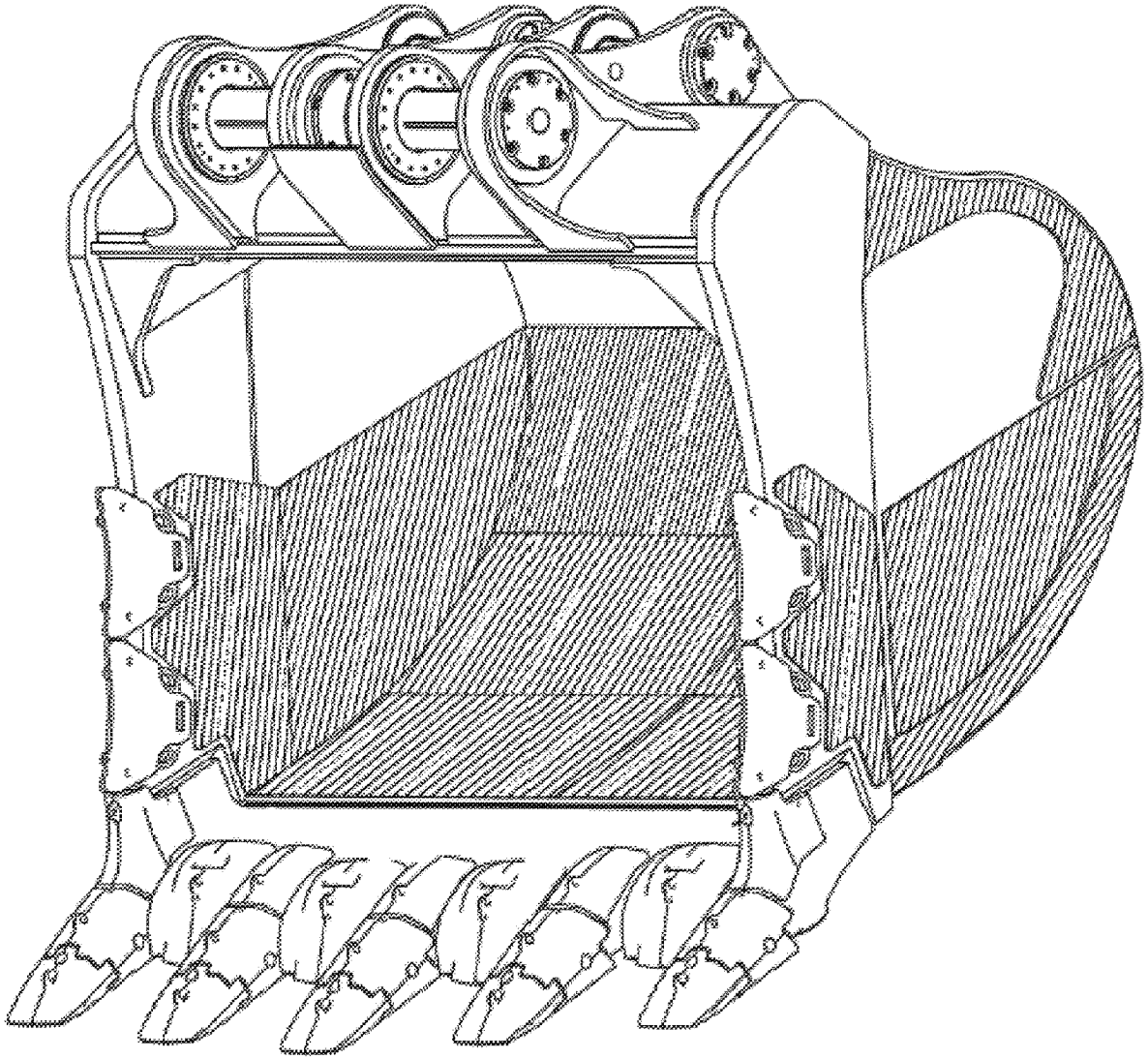
Figure 2 (prior art)
Figure 3:
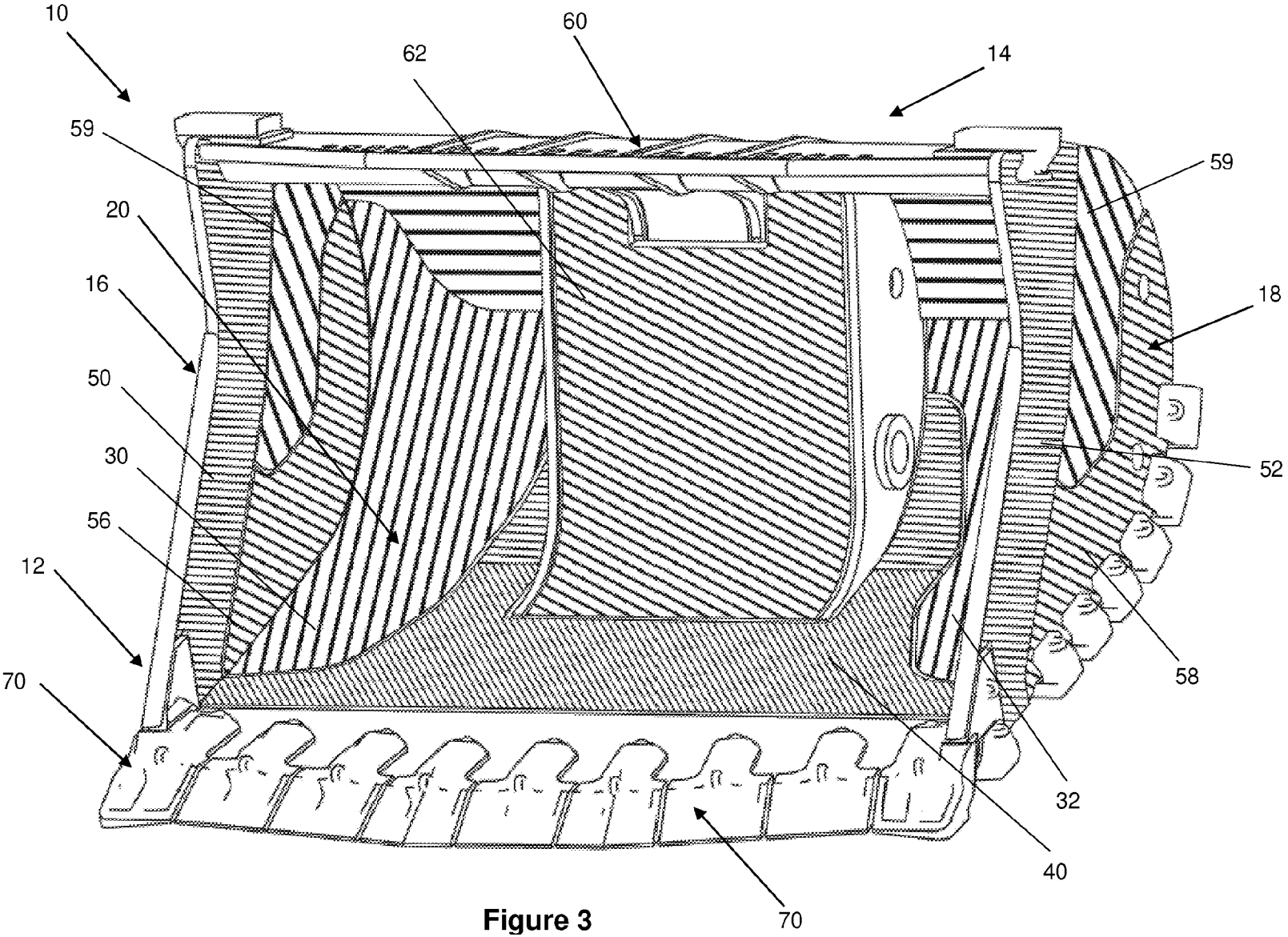
Figure 4:
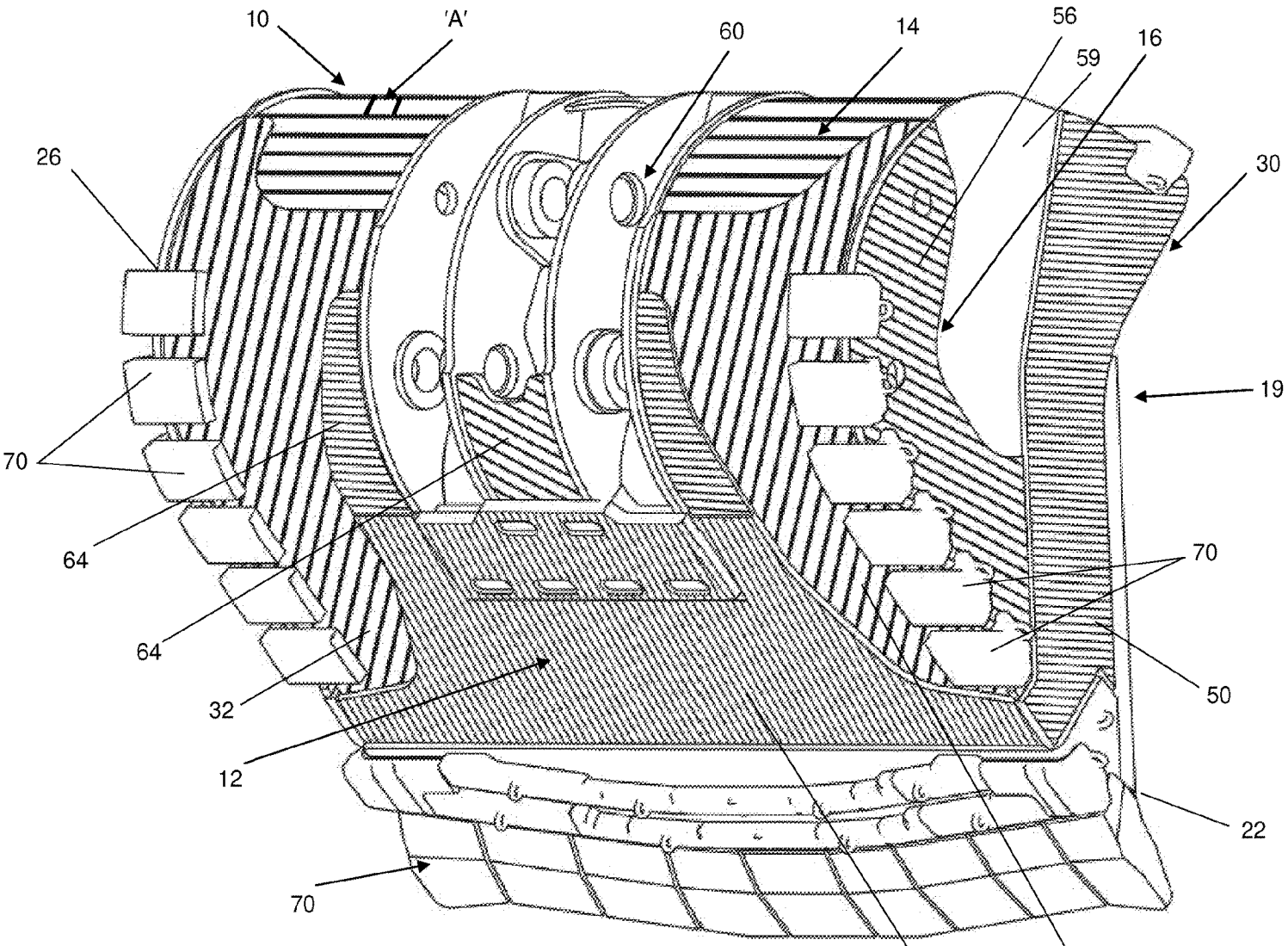
Figure 5:
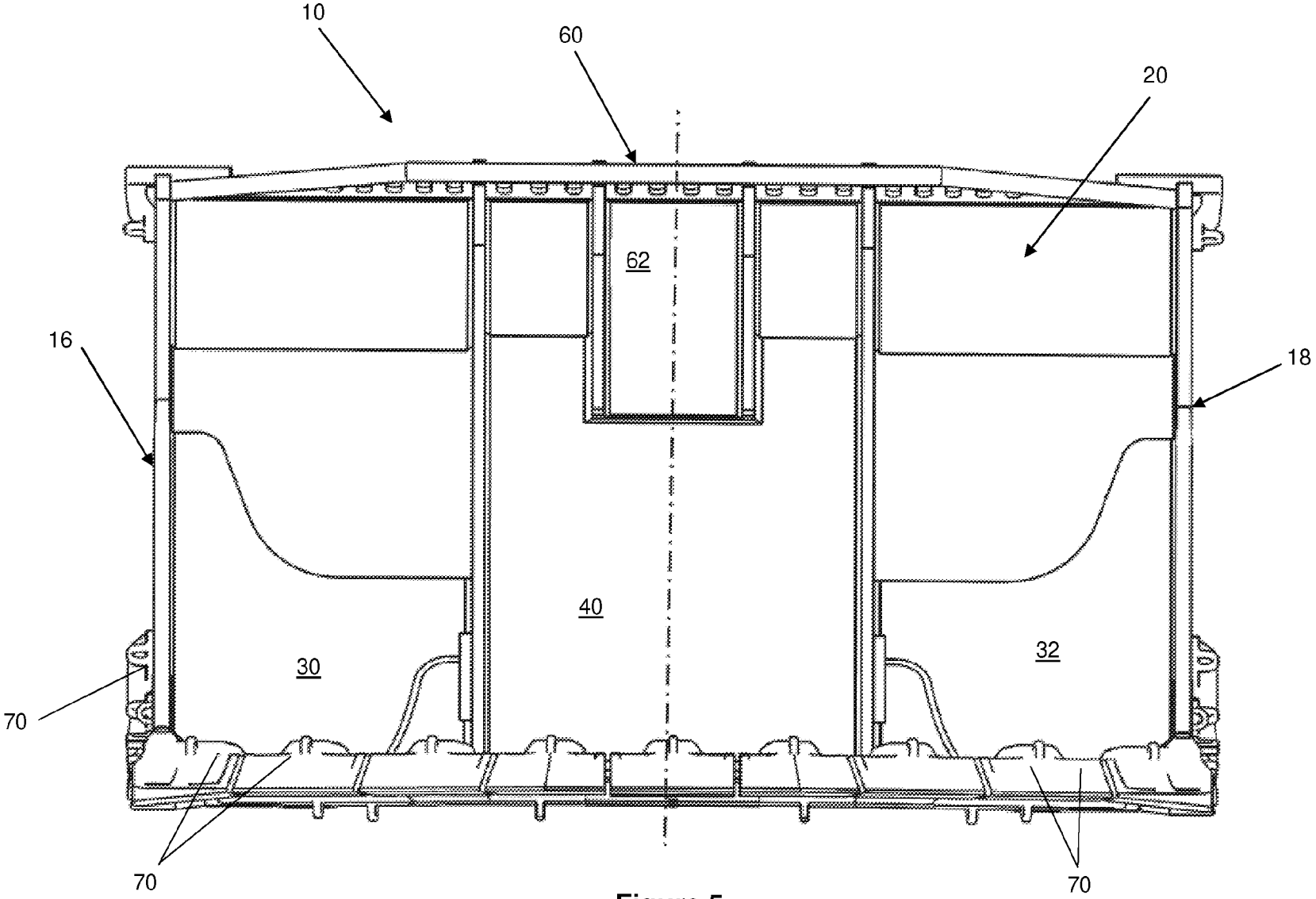
Figure 6:
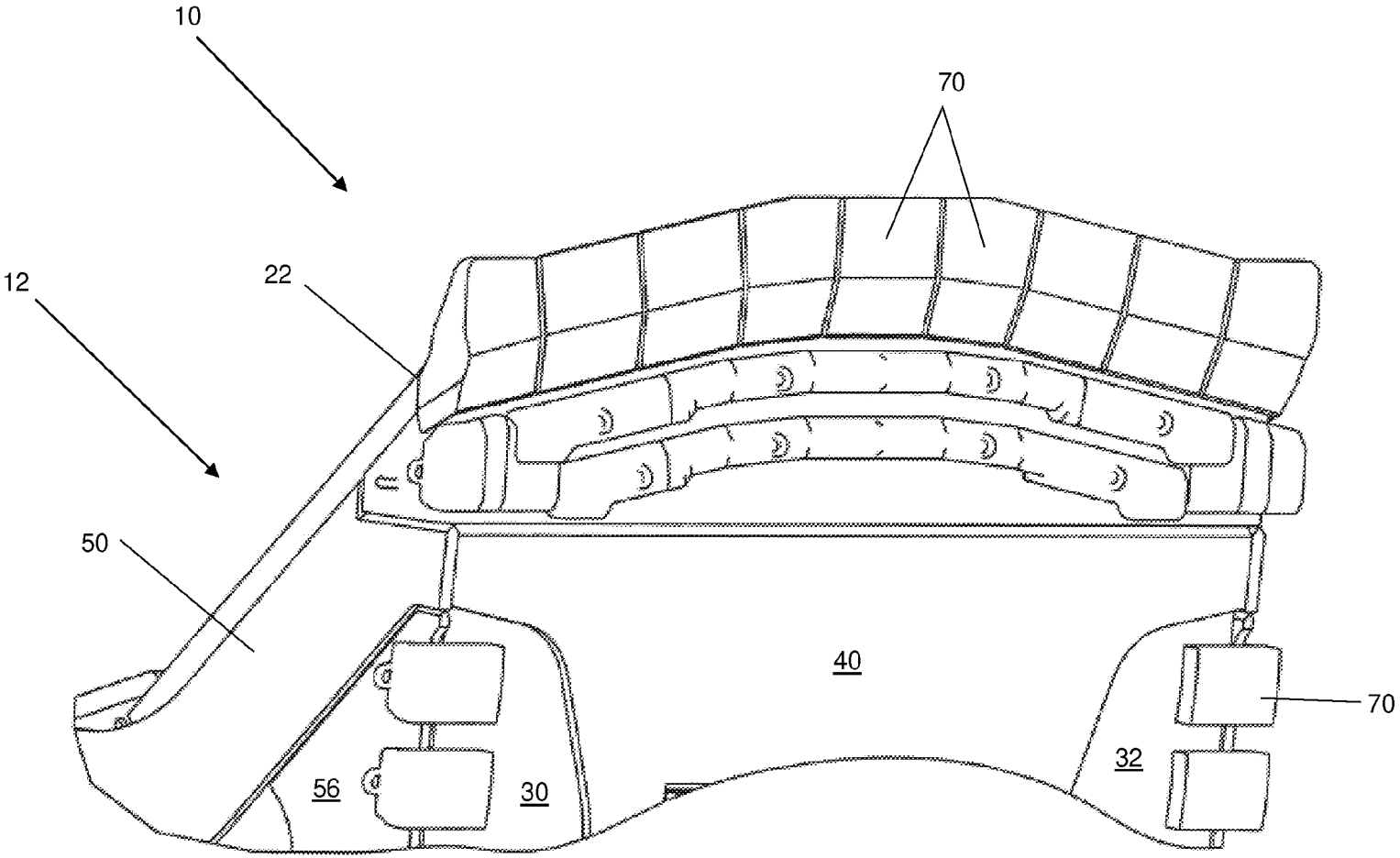
Figure 7:
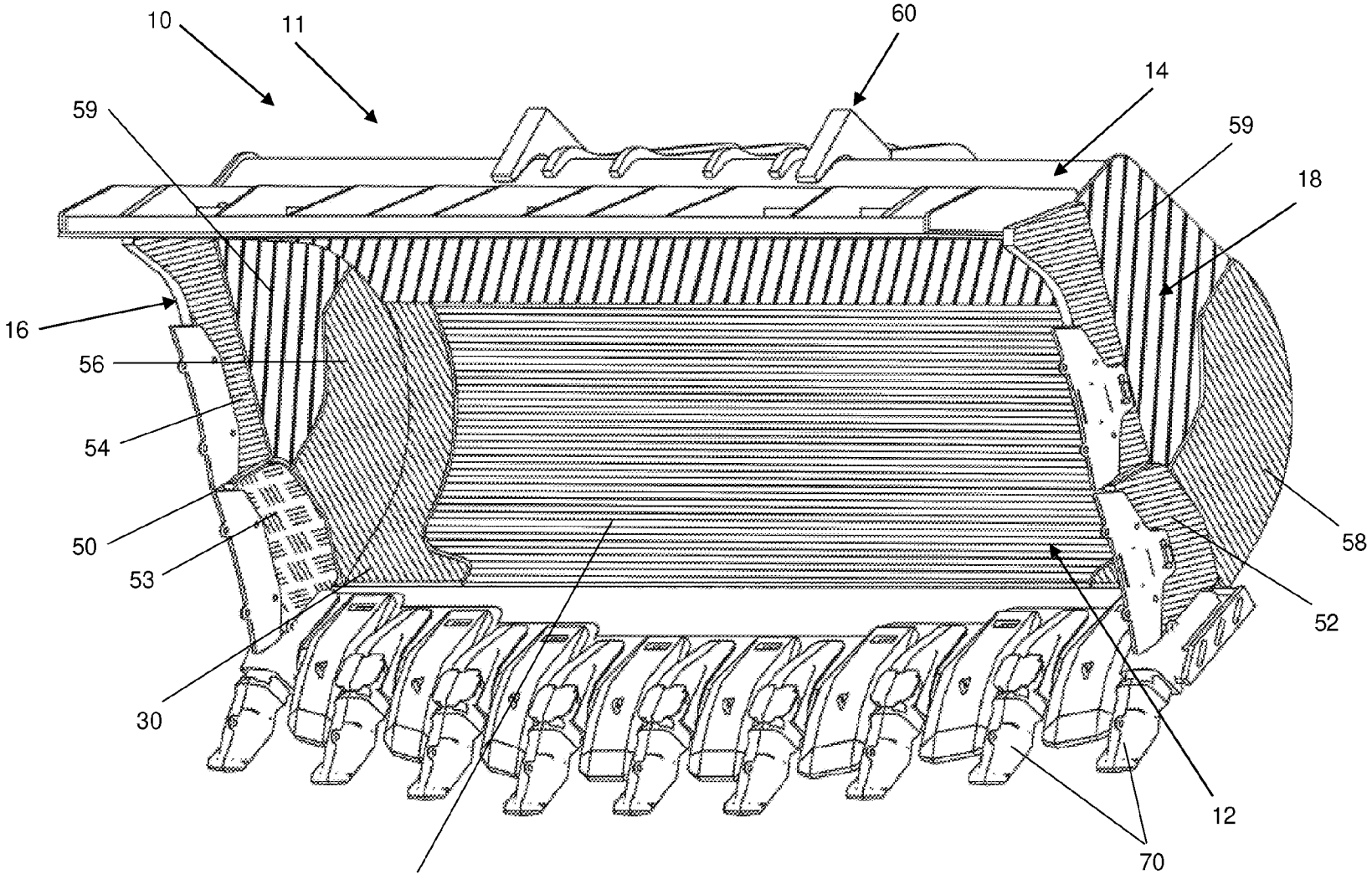
Figure 8:
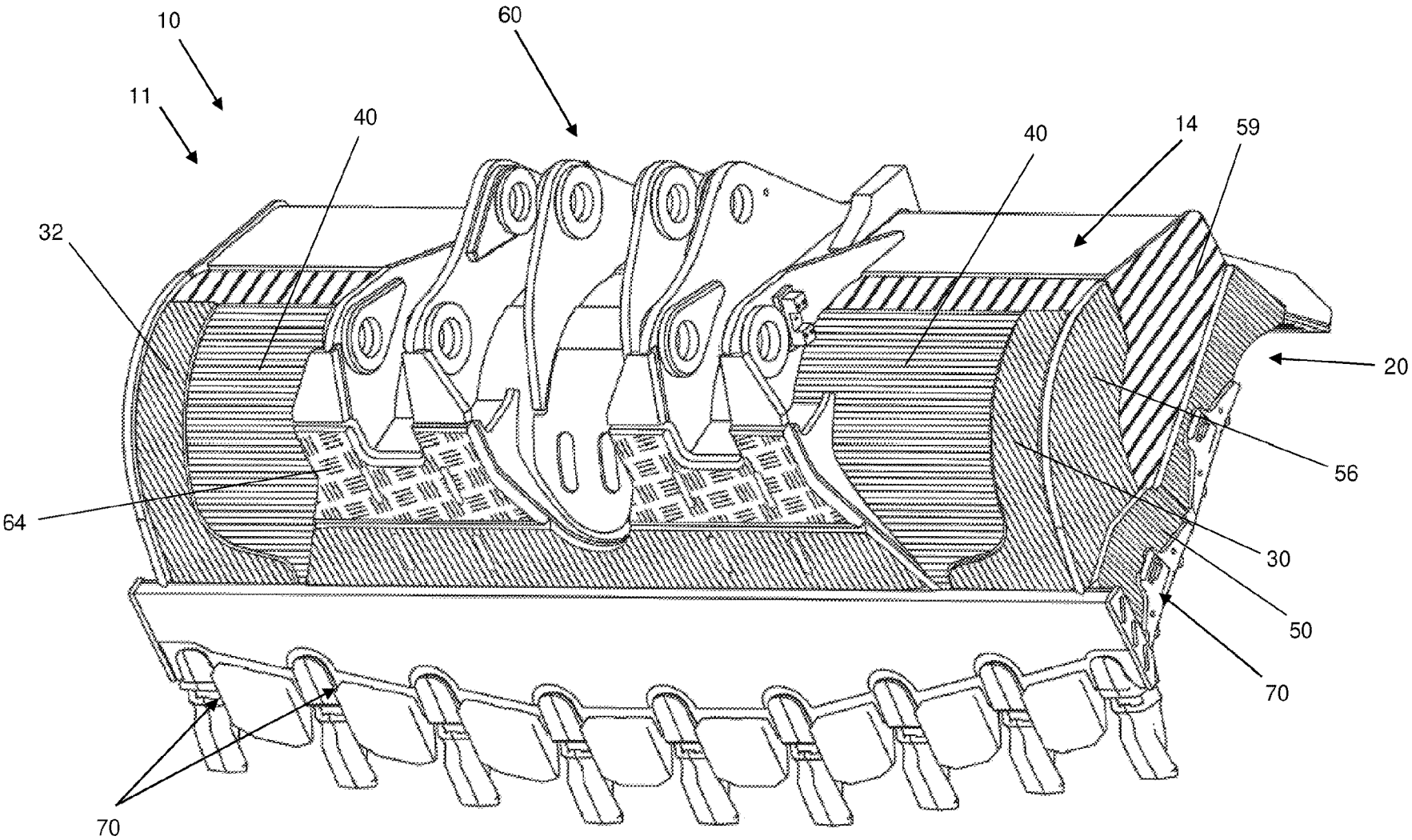

FIG. 2 is a perspective view of a prior art bucket used for excavation having a set of removeable and replaceable liners welded to high wear regions thereof;

FIG. 3 shows a front perspective view of a bucket for an LHD loader in accordance with one embodiment of the invention;

FIG. 4 shows a rear perspective view of the bucket of FIG. 3;

FIG. 5 shows a front view of a bucket that is broadly similar to the bucket in FIG. 3;

FIG. 6 shows a perspective view of an underside of a bucket like that in FIG. 3 showing an example of a removable ground engaging tool (GET) system mounted on the bucket;

FIG. 7 shows a front perspective view of a bucket for an above ground loader in accordance with a second embodiment of the invention; and FIG. 8 shows a rear perspective view of the bucket of FIG. 7.

The different shading lines on FIGS. 3 to 8 indicate different thicknesses of steel used in the various zones of the bucket.

DETAILED DESCRIPTION

FIG. 2 illustrates a prior art bucket fitted with removable liners welded onto the walls of the bucket which has been described above in the background to the disclosure. It will therefore not be described in more detail in this specific description.

FIG. 1 shows a load haul dump loader 1 (LHD) of a type that is used in underground mining. The LHD loader 1 includes a prime mover 2 mounted on wheels 3 and has a bucket controlling arrangement 5 including arms 6 projecting forward from the prime mover 2. A bucket 10 in turn is interchangeably mounted on a front end of the arms 6.

FIGS. 3 to 6 illustrate a bucket in accordance with one embodiment of the invention suitable for use on an LHD loader used in underground mining. In the drawings, the bucket is indicated generally by the reference numeral 10.

The bucket 10 includes a main wall 11 which transitions from a lower main wall portion 12 into an upper main wall portion 14 and one side wall 16 extending between the lower main wall portion 12 and the upper main wall portion 14 on one side. It also includes another side wall 18 extending between the lower and the upper main wall portions 12 and 14 on the other side. The main wall and the side walls 16 and 18 together define an interior space 19 and an open mouth 20 at a front end 22 of the bucket 10 through which material enters and is discharged from the bucket 10.

In FIGS. 3 to 6, the bucket does not have replaceable wear liners welded onto the main and side walls thereof. Each wall or portion thereof is engineered to accommodate wear during use of the bucket by selection of a thickness of steel and a BHN hardness of steel that provides an appropriate structural strength and wear resistance. The lower portion 12 and upper portion 14 of the main wall 11 and the side walls 16 and 18 stay permanently in place for the lifetime of the bucket 10.

The lower main wall portion 12 extends rearward from the mouth 20 at the front end 22 of the bucket 10 and transitions into the upper main wall portion 14 at a rear end 26 of the bucket 10. From this point at the rear end 26, the upper main wall portion 14 turns back and extends forward towards the mouth 20 of the bucket 10. The rear end 26 of the bucket is the rearmost point of the bucket when it is resting on a support surface such as the ground as shown in FIG. 1*b*. The upper main wall portion 14 includes 'a base wall section' representing a region of the bucket that encounters the least wear and where the steel plate forming the bucket is thinnest. This region provides a convenient reference point against which the thickness of other regions, portions of walls and zones of walls can be measured. An area of the upper main wall portion 14 representative of the base wall section is indicated by the letter 'A' in FIG. 4. The thickness of the base wall section in turn has a 'base wall thickness'.

The 'base wall thickness' is less than the thickness of steel plate on the various zones of the lower main wall portion 12 of the main wall 11, and various zones on the side walls 16, 18. Further, the base wall section also has a BHN value that is less than that of the other wall portions and zones. For example, the base wall section may have a BHN of less than 400 BHN, e.g. 250 to 350 BHN, and the other portions and zones may have a BHN of at least 400 BHN.

The different zones of the main wall 11 and side walls 14, 16 which are subject to differing levels of wear and engineered with different thicknesses will now be described.

The lower main wall portion 12 has lower main wall side zones 30, 32 on each side thereof towards the side walls 16 and 18, and the lower main side wall zones 30, 32 have a thickness that is at least 80% thicker than the base wall thickness.

The lower main wall side zones 30, 32 extend from a front end 22 adjacent to or proximate to the mouth 20 at least to a rear end of the lower main wall portion 12.

In the illustrated embodiment, the lower main wall side zones 30, 32 extend into the upper wall main wall portion 14. Further, the mean or average width of the lower main wall side zones 30, 32 is at least 50% of the width of the lower main wall portion 12 of the bucket 10.

In addition to the increased thickness of the lower main wall side zones 30, 32, they also have a BHN that is at least 20% greater than the BHN of the base wall section. This increased BHN helps to resist wear of the lower main wall side zones 30, 32.

The lower main wall portion 12 further includes an intermediate lower main wall zone 40 positioned between the two lower main wall side zones 30 and 32. The intermediate lower main wall zone 40 has a thickness that is at least 80% thicker than the base wall thickness. Further, in the bucket in FIG. 3, the intermediate lower main wall zone 40 is thicker than the lower main wall side zones 30 and 32.

Further as shown in FIG. 3, the intermediate lower main wall zone 40 may optionally broaden out towards the front end 22 of the bucket 10 and lower portion of the main wall 12 and extend substantially across a full width of the bucket 10.

The different zones on the two side walls 16 and 18 will now be described. Each side wall 16, 18 has an upstanding frontal zone 50, 52 extending from the lower main wall portion 12 to the upper main wall portion 14 adjacent to the mouth 20. The upstanding frontal zone 50, 52 has a thickness that is at least 100% greater than the base wall thickness. This therefore reflects a high level of wear to which the upstanding frontal zones 50, 52 are subjected in use.

Further, each upstanding frontal zone 50, 52 has a width extending rearward from the front end 22 that extends for a distance that is at least 10% of the depth of the bucket 10. The depth of the bucket 10 is a linear distance from the front end 22 to the rear end 26 of the bucket 10. In FIG. 3, the upstanding frontal zones 50, 52 each comprise a single section having the same thickness and hardness across the extent of the zone.

Each side wall 16, 18 further includes a lower arcuate edge zone 56, 58 extending from the mouth 20 rearward along a lower edge of the side wall 16, 18 that is adjacent to the lower main wall portion 12. Each lower edge zone 56, 58 has a thickness that is at least 90% greater than the base wall thickness.

The upstanding frontal zone 50, 52 has a thickness that is at least 20% greater than the lower main side wall zones 30, 32 on the lower main wall portion 12. In addition, the thickness of the upstanding frontal zone 50, 52 of the side wall 16, 18 is at least 10% greater than the thickness of the lower edge zone 56, 58. As shown in FIGS. 3 and 4, the width of the arcuate edge zone 56, 58 varies along the lower edge of the side wall 16, 18 and the mean width of the lower edge zone 56, 58 is greater than the mean width of the upstanding frontal zone 50, 52.

The side walls 16 and 18 further include a remainder zone 59 covering the remainder of the side wall 16, 18, i.e. outside of the frontal zones 50, 52 and the lower edge zones 56 and 58. The remainder zone 59 is typically formed of a single thickness of steel that is thinner than the frontal zones 50, 52 and also the lower edge zones 56, 58. This reflects the fact that the remainder zone 59 is subjected to less wear than the frontal and lower edge zones 50 and 56. The wear of the remainder zone 59 is more comparable to the wear on the upper main wall portion 14 and typically its thickness may be more comparable to that of the upper main wall portion 14.

The bucket 10 also includes a bucket handling arrangement including ears indicated generally by reference numeral 60, for interacting with a bucket manoeuvring system on a loader to control and manoeuvre the bucket 10.

In FIGS. 3 to 6, where the bucket 10 is to be used on an underground LHD loader, the bucket handling arrangement 60 is partly received within the interior space 19 of the bucket 10. The bucket 10 has an internal bucket handling arrangement plate 62 within the interior space 19 of a bucket extending across the bucket handling arrangement 60. The internal bucket handling arrangement plate 62 is substantially centrally positioned on the main wall equidistant from the side walls 16 and 18 and has a thickness that is at least 90% thicker than the base wall thickness.

The bucket in FIGS. 3 to 6 also has at least one external bucket handling arrangement plate 64 on an outer surface of the main wall 11 of the bucket 10. These plates 62 and 64 may have greater thickness than the lower main wall side zones 30, 32 and accommodate increased wear adjacent to and on the bucket handling arrangement 60.

The bucket 10 in FIGS. 3 to 6 further includes replaceable ground engaging (GET) formations 70 mounted on the lower portion of the main wall 12 and the side walls 16 and 18 of the bucket 10.

The GET formations 70 are standard consumable wear items of equipment used on buckets in the mining industry. The GET formations 70 are mounted on regions of extreme wear on the bucket 10 and are used to shield the steel forming the walls of the bucket in these regions. The GET formations 70 wear out over time with operational use of the bucket 10 and are periodically replaced. The GET formations 70 are quite different from the prior art removable liners discussed in the background that are welded onto the steel walls of the bucket 10. This distinction would be recognized by persons skilled in the art.

The GET formations 70 are typically mounted on the bucket by means of mechanical fastening systems, although some of the components may be welded on, and are adapted to be removed from a bucket 10 and replaced quickly and easily with minimal downtime. The GET formations are mounted in the following locations:

- along the front end of the lower main wall portion;
- on the side walls at the front end;
- along the lower ends of the side walls in a direction rearward of the front end; and
- on an underside of the lower main wall portion towards the front end.

The GET formations 70 are illustrated most clearly in FIG. 6 of the drawings and include cutting teeth on a lip of the bucket 10 and lip shrouds positioned intermediate the teeth. The teeth and lip shrouds are typically mechanically fastened to the lower main wall portion 12 of the bucket 10. The GET formations further include underside lip profile bars. These bars are preferably segmented along their lengths to resist stress from building up along their lengths. These bars are also mechanically attached and shield an outer surface of the lower main wall portion from broken rock material when the bucket is driven into a muck pile. The GET formations 70 further include heel shrouds which are welded to the bucket spaced along the lower edge of the side walls. Related to heel shrouds, the GET formations may include heel blocks and corner blocks. The GET formations further include grouser bar edge protection extending up the side walls over the upstanding frontal zones of the side walls. The grouser bars shield the side walls and are typically mechanically attached to the bucket. Yet further, the GET may include side cutter bars.

A set of GET formations may typically be supplied as a set by SANDVIK™ or by CATERPILLAR™. These systems are largely mechanically attached to the bucket although some components such as the heel shrouds or heel blocks may be welded to the bucket.

The thicknesses of steel used for the base section of the upper portion of the main wall 14, and also the other walls, wall portions and zones of the bucket in FIG. 3, will now be described.

In the FIG. 3 embodiment, the base wall section on the upper main wall portion 14 has a base wall thickness of 16 mm which represents a minimum wall thickness across the bucket. It is quite typical for the buckets of LHD loaders to have a base wall thickness of 16 mm and there is very little variation around this measurement. The conditions in which these loaders operate in underground tunnels limits the variation of size on these loaders and this helps to explain why there is very little variation in the base wall thickness of buckets used on this equipment.

The lower main wall side zones 30 and 32 each have a thickness of about 25 mm. The intermediate lower main wall zone 40 has a thickness of 40 to 50 mm. In the FIG. 3 embodiment, this zone 40 comprises two discrete sections, namely, a forward section of 50 mm thickness and a rear section of 50 mm thickness. These two sections are shown in FIG. 3 of the drawings.

The upstanding frontal zones 50, 52 on the side walls 16, 18 have a thickness of 40 mm and the lower arcuate edge zones 56, 58 have a thickness of about 32 mm. The remainder of each side wall 30, 32 forms a remainder zone 59 having a thickness of about 20 mm.

In the FIG. 3 embodiment, the internal handling arrangement plate 62 has a thickness of 32 mm. The external handling arrangement plates 64 on the outer surface have thicknesses selected from 32 mm, 40 mm and 50 mm depending on the level of wear to which they are each exposed.

The BHN hardness of the lower main side wall zones, intermediate lower main wall zone, frontal upstanding zones and lower arcuate edge zones may be in the range of 400 to 500 BHN. This BHN hardness is higher than that for the upper main wall portion 14 and optionally also the remainder zone 59. In some embodiments, the frontal upstanding zones 50, 52 on the side walls 16 and 18, and the intermediate lower main wall zone may have a higher BHN hardness, e.g. a BHN of 500 than the other zones.

In use, the bucket in FIG. 3 is mounted on an LHD loader and used for handling broken rock material at a mine site in the normal way.

Over time with accumulated use, high wear zones of the bucket 10, namely the lower main side wall zones 30, 32, intermediate lower main wall zone 40, frontal upstanding zones 50, 52 and lower edge zones 56, 58 of the side walls 16, 18 wear down. However, these zones are fabricated with increased thickness so they can accommodate the wear without failing.

Further, the increased hardness of the high wear zones with a BHN of 400 to 500 also helps to resist wear of the high wear zones of the bucket 10. As a result, no liners need to be welded onto the bucket during the working lifetime of the bucket and maintenance of the buckets is consequently minimal. When a zone of the bucket eventually fails, the entire bucket is replaced with a new bucket. This significantly reduces the downtime of LHD loaders when compared the downtime due to maintenance performed on the walls and/or replaceable liners of a prior art bucket.

FIGS. 7 and 8 illustrate a bucket in accordance with a second embodiment of the invention that can conveniently be used an above ground loader. The bucket in FIGS. 7 and 8 has many similarities with the bucket in FIGS. 3 to 6 and, unless otherwise indicated, the same reference numerals will be used to refer to the same components. Further, the following description will focus on the differences between this embodiment and the earlier embodiment.

In FIGS. 7 and 8, the bucket 10 is again made from a single layer of plate steel that has different thicknesses in different zones of the bucket.

The bucket 10 is used on an above ground loader for which space is less restricted, the bucket handling arrangement 60 is less received in the interior space 19 of the bucket 10. It sits more outside the bucket than the arrangement 60 in the FIG. 3 bucket and projects from the outer surface of the bucket 10 towards the rear end 26. Further, the bucket 10 is considerably more elongated than the bucket in FIG. 3, because it is not constrained by working in an underground tunnel of confined lateral width. Typically, the width of the bucket on a wheeled above ground loader is the same as the width of the tyres of the loader.

The bucket 100 in FIGS. 7 and 8 has the same upper main wall portion 14 and lower main wall portion 12 on a main wall 11 and side walls 16 and 18 as the bucket described above with reference to FIG. 3.

Further, the lower main wall portion 12 includes lower main side wall zones 30, 32 and an intermediate lower main wall zone 40 on the main wall. The side walls include frontal upstanding zones 50, 52 and arcuate edge zones 56, 58. The bucket also has a plurality of external bucket handling arrangement plates 64 on the bucket handling arrangement 60. The external bucket handling arrangement plates 64 are thus mounted on an outward facing surface adjacent to the handling arrangement 60 well away from the interior space 19 of the bucket 10. The external bucket handling arrangement plates 64 have a thickness that is at least 90% greater than the base wall thickness.

In FIGS. 7 and 8, each upstanding frontal zone 50, 52 of the side walls 16 and 18 is further divided into a lower upstanding frontal section 53 and an upper upstanding frontal section 54, and the thickness of the lower upstanding frontal section 53 is greater than the thickness of the upper upstanding frontal section 54.

Further, the lower upstanding frontal section 53 extends a distance of 20 to 40% of the height of the side wall adjacent to the mouth 20, and the upper upstanding frontal section 54 extends up a distance of 60 to 80% up the height of the side wall. This feature enables the upper and lower upstanding frontal sections 53, 54 to be engineered from different thicknesses of steel and also different BHN hardness to cater for their different wear conditions.

The thickness of steel used for the base section of the upper portion 14 of the main wall, and also the other zones of the bucket in FIGS. 7 and 8 will now be described.

In the FIG. 7 embodiment, the base wall thickness of the base wall is 25 mm and a large part of the upper main wall portion 14 is formed with this base wall thickness. Buckets for above ground loaders would typically have a base wall thickness in the range of 16 mm to 25 mm. Additionally, applicant is aware of a small number of large buckets that have a base wall thickness of 30 to 32 mm.

The lower main wall side zones 30 and 32 of the lower main wall portion 12 each have a thickness of about 50 mm and the intermediate lower main wall zone 40 has a thickness of about 40 mm. In the FIG. 7 embodiment, unlike the FIG. 3 embodiment, the zone 40 comprises only a single intermediate lower main wall zone that extends across the width of the bucket 10 from the lower side wall zone 30 to lower side wall zone 32. The intermediate lower main wall zone 40 is uninterrupted because the bucket handling arrangement 60 does not project into the interior space 19.

In FIG. 7, the lower section 53 of the upstanding frontal zones 50, 52 has a thickness of about 70-80 mm and the upper section 54 has a thickness of about 70-80 mm.

The lower edge zones 56, 58 have a plate thickness of about 50 mm. The remainder zone 59 of each side wall 16 and 18, outside the frontal and lower edge zones 32, 56, has a plate thickness of about 25 mm. This is about one half of the plate thickness of the lower arcuate edge zones on the side wall 16, 18 reflecting the fact that it is less exposed to wear.

In the FIG. 7 embodiment, the external handling arrangement plates 64 on the outer surface have thicknesses varying from 50 to 80 mm depending on the level of wear to which they are each exposed.

In the FIG. 7 bucket, the BHN hardness of the lower main side wall zones, intermediate lower main wall zones, frontal upstanding zones and lower arcuate edge zones lies in the range of 400 to 500 BHN, e.g. 450 BHN. This BHN hardness may be higher than the BHN for the upper main wall portion 14 and optionally also the remainder zone 59. In fact, some of the high wear zones including the frontal upstanding zones 50, 52 on the side walls 16, 18, the lower main wall side zones 30, 32 and the intermediate lower main wall zone 40 may have a higher BHN hardness, than the other zones, e.g. a BHN of 500.

As described above in the FIG. 7 embodiment, the base wall thickness is 25 mm which is significantly greater than that of the FIG. 3 embodiment which is 16 mm. It will be recognized by persons skilled in the art that the base wall thickness for different mining applications and different sizes of loaders and buckets and will be different. Consequently, the thicknesses of the other portions and zones on the bucket will also be quite different for different applications. However, it is the relative thickness of the various portions and zones relative to the base wall thickness that is a feature of the current application.

The buckets in FIGS. 3 and 7 described above with reference to the drawings have been developed after extensive research and development by the applicant. By engineering different zones of the buckets with different thicknesses of steel and a different hardness of steel, applicant has surprisingly been able to develop a bucket with permanent walls and no replaceable liners having commercially acceptable longevity. Further, the applicant can produce the bucket at a commercially viable cost.

In the prior art, persons skilled in the art would not have thought it possible to build a bucket with permanent walls that are not covered with replaceable liners, or replaceable walls or wall portions, to counter the wear and abrasion in harsh mining conditions.

One working advantage of a bucket described in the embodiments in FIGS. 3 and 7 is that the bucket is used in the form in which it is manufactured for the lifetime of the bucket. The different regions or zones of the bucket are engineered to accommodate the wear that occurs over the lifetime of the bucket.

The buckets do not have liners, so they avoid downtime for removal and replacement of the liners and also avoid the labour cost incurred when replacing a set of liners. Further, there is no risk of release of stored energy because there are no replaceable liners.

Yet further, the buckets do not suffer from an increase in drag affecting their ability to dig into material and load the material in the bucket. Further, the buckets can discharge material from the bucket without a reduction in the rate of discharge.

Yet further, the bucket carries a greater payload of broken rock material because there is no dead space in the bucket occupied by liners mounted on the walls thereof.

The term 'base wall section' may refer to a point on the upper main wall portion of the bucket where the thickness of steel is at its minimum thereby providing a reference against which the thickness of steel at other points can be measured.

The term 'base wall thickness' may correspondingly refer to the thickness of the base wall section.

In this specification, the term 'liner less bucket' may be understood to mean a bucket that is made of a layer of steel plate that remains in place for the lifetime of the bucket. In particular, the liner less bucket does not have a set of replaceable liners which are welded to the walls of the bucket to increase wear resistance, and which are replaced several times over the working life of the bucket.

In this specification, the term 'thickness of a wall or portion or zone of a wall' may be understood to mean an average or mean thickness of the plate steel on the wall, portion or zone as the case may be. In particular, the thickness of the upper portion of the main wall, the lower portion of the main wall and zones of the side walls may be understood to mean an average or mean thickness of these wall, portions and zones.

In this specification, the term 'BHN' hardness of plate steel used on a wall or portion or zone of a wall' may be understood to mean an average or mean BHN hardness of the plate steel on the wall, portion or zone as the case may be. In particular, the BHN hardness of the plate steel on the upper portion of the main wall, the lower portion of the main wall and the side walls shall be understood to mean an average or mean hardness of the steel used in the respective regions.

Further in relation to thickness of plate steel, a person skilled in the field of large mining buckets may understand that the thickness mentioned about may vary by + or – minus 2 mm, depending on the manufacture. Therefore, the thickness of plate steel may be construed in this context in this patent specification.

In this specification, the terms 'comprises', 'comprising', 'includes', 'including', or similar terms are intended to mean a non-exclusive inclusion, such that a method, system or apparatus that comprises a list of elements does not include those elements solely but may well include other elements not listed unless the context indicates otherwise.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching.

Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

The invention claimed is:

1. A linerless bucket for use on a loader, the bucket including:

a main wall which transitions from a lower main wall portion into an upper main wall portion having an upper main wall portion thickness;

one side wall extending between the lower main wall portion and the upper main wall portion on one side, and another side wall extending between the lower and the upper main wall portions on the other side, the main wall and the side walls forming a wear surface and together defining an interior space with an open mouth through which material enters and is discharged from the bucket, and the lower main wall portion comprises steel that has a Brinell hardness number (BHN) of at least 400, and a thickness that is at least 20% thicker than the upper main wall portion thickness, and each of the one and other side walls comprises steel that has a BHN of at least 400 and a thickness that is at least 20% thicker than the upper main wall portion thickness, wherein the lower main wall portion, the upper main wall portion, and the side walls are engineered with a thickness and hardness of steel to last for a lifetime of the linerless bucket.

2. The linerless bucket according to claim 1, wherein the lower main wall portion extends rearward from the mouth at a front end of the linerless bucket and transitions into the upper main wall portion at a rear end of the linerless bucket at which point the main wall portion turns back and extends forward towards the mouth of the linerless bucket.

3. The linerless bucket according to claim 2, wherein the lower main wall portion has a thickness that is at least 50% thicker than the upper main wall portion thickness, and the one and other side walls have a thickness at least 50% thicker than the upper main wall portion thickness.

4. The linerless bucket according to claim 1, wherein the lower main wall portion comprises: a lower main wall side zones on each side thereof towards the side wall, each lower main side wall zone and an intermediate lower main wall zone extending between the lower main wall side zones, wherein the thickness of the intermediate lower main wall zone is different from the thickness of each lower main side wall zone.

5. The linerless bucket according to claim 4, wherein the lower main wall side zones extend from a front end adjacent to the mouth of the lower main wall portion to a rear end of the lower main wall portion.

6. The linerless bucket according to claim 4, wherein each lower main wall side zone comprises steel having a substantially constant thickness across its surface, and each lower main side wall zone has a thickness at least 20% thicker than the upper main wall portion thickness.

7. The linerless bucket according to claim 1, wherein each side wall includes an upstanding frontal zone extending substantially from the lower main wall portion to the upper main wall portion adjacent to the mouth, and the upstanding frontal zone comprises steel having a thickness that is at least 50% greater than the upper main wall portion thickness, and a BHN of 400 to 500.

8. The linerless bucket according to claim 7, wherein each upstanding frontal zone has a mean width extending rearward from a front end of the side wall that is at least 10% of the depth of the linerless bucket, the depth of the bucket being a linear distance from the front end to the rear end of the side wall.

9. The linerless bucket according to claim 7, wherein each side wall includes an arcuate or curved lower edge zone extending rearward along a lower edge of the side wall that is adjacent to the lower main wall portion, and the lower edge zone comprises steel having thickness that is at least 50% greater than the upper main wall portion thickness, and a BHN of 400 to 500.

10. The linerless bucket according to claim 9, wherein the thickness of the steel forming the upstanding frontal zone of each side wall is at least 10% greater than the thickness of the lower edge zone on the respective side wall.

11. The linerless bucket according to claim 1, including a bucket handling arrangement to facilitate controlling and maneuvering a bucket on a loader, the bucket handling arrangement being received to some extent within the interior space of the linerless bucket to reduce the space taken up by the linerless bucket, and an internal handling arrangement plate on or adjacent to the bucket handling arrangement having a thickness that is at least 50% greater than the upper main wall portion thickness.

12. The linerless bucket according to claim 11, including an external handling arrangement plate outside of the interior space on or adjacent to the bucket handling arrangement, the external handling arrangement plate comprising steel having a thickness that is at least 50% greater than the upper main wall portion thickness.

13. The linerless bucket according to claim 1, including replaceable ground engaging (GET) formations mounted on the main wall and one and other side walls of the bucket that are mounted on the bucket by means of mechanical fastening systems operable to enable worn ground engaging formations to be removed from the linerless bucket when they are worn and be replaced efficiently.

14. A loader including:

a prime mover having ground engaging formations for moving across the ground, and a bucket controlling arrangement mounted on the prime mover including arms projecting forward from the prime mover, and the linerless bucket as claimed in claim 1 mounted on the arms.

15. The linerless bucket according to claim 9, wherein the lower edge zone on each side wall has a mean width that is at least 20% greater than the mean width of the upstanding frontal zone, and the lower edge zone has a thickness that is at least 90% thicker than the upper main wall portion thickness.

16. A linerless bucket for use on a loader, the bucket including:

a main wall comprising a lower main wall portion and an upper main wall portion having an upper main wall portion thickness, one side wall extending between the lower main wall portion and the upper main wall portion on one side, and another side wall extending between the lower and the upper main wall portions on the other side, the main wall and the one and other side walls forming a wear surface and together defining an interior space with an open mouth through which material enters and is discharged from the linerless bucket, the one and other side walls include an upstanding frontal zone extending substantially from the lower main wall portion to the upper main wall portion adjacent to the mouth, each upstanding frontal zone has a thickness that is at least 20% greater than the upper main wall portion thickness, and a BHN of at least 400, and the one and other side walls include a lower edge zone extending rearward along a lower edge of the side wall that is adjacent to the lower main wall portion, and each lower edge zone has a thickness that is at least 20% greater than the upper main wall portion thickness, and a BHN of at least 400.

17. The linerless bucket for use on a loader according to claim 16, wherein the lower main wall portion has a thickness that is at least 20% thicker than the upper main wall portion, and a BHN of at least 400.

18. The linerless bucket for use on a loader according to claim 16, wherein the lower main wall portion has lower main wall side zones on each side thereof towards the one and other side walls, and each lower main side wall zone has a thickness that is at least 20% thicker than the upper main wall portion thickness.

19. The linerless bucket for use on a loader according to claim 17, wherein the lower main wall portion has a thickness that is at least 50% thicker than the upper main wall portion thickness.

20. The linerless bucket for use on a loader according to claim 18, wherein each lower main side wall zone has a thickness that is at least 50% thicker than the upper main wall portion thickness.

21. The linerless bucket for use on a loader according to claim 16, wherein the upstanding frontal zone has a thickness that is at least 50% greater than the upper main wall portion thickness.

22. The linerless bucket for use on a loader according to claim 16, wherein the lower edge zone has a thickness that is at least 50% thicker than the upper main wall portion thickness.

* * * * *